United States Patent [19]

Chapin

[11] 4,090,347

[45] May 23, 1978

[54] SPINNING WHEEL YARN GUIDE

[76] Inventor: Doloria M. Chapin, R.D. 1, 2178 Pompey-Fabius Rd., Fabius, N.Y. 13063

[21] Appl. No.: 809,916

[22] Filed: Jun. 24, 1977

[51] Int. Cl.[2] ..... D01H 1/04; D01H 7/24; D01H 7/48

[52] U.S. Cl. ..... 57/71

[58] Field of Search ..... 57/34 R, 67, 68, 70, 57/71, 115–117; 242/47

[56] References Cited

U.S. PATENT DOCUMENTS

| | | | |
|---|---|---|---|
| 147,200 | 2/1874 | Voegtli | 57/67 X |
| 249,289 | 11/1881 | Bastow et al. | 57/71 X |
| 829,467 | 8/1906 | Gregory et al. | 57/71 |
| 2,143,203 | 1/1939 | Maxham | 57/71 X |
| 2,623,347 | 12/1952 | Bishop | 57/71 X |

FOREIGN PATENT DOCUMENTS

| | | | |
|---|---|---|---|
| 889,700 | 1/1944 | France | 57/67 |

*Primary Examiner*—Donald Watkins
*Attorney, Agent, or Firm*—Charles S. McGuire

[57] ABSTRACT

A spinning wheel having manually positionable means for guiding the spun yarn as it is wound on the bobbin to provide more even distribution of the coiled yarn along the length of the bobbin. A collar carrying a yarn guide member in the form of a hook encircles one of the arms of the flyer for sliding movement along the length thereof. A permanent magnet mounted upon the collar yieldably fixes the position thereof upon the flyer arm, which carries an elongated strip of material to which the magnet is attracted, until moved by the operator.

5 Claims, 3 Drawing Figures

SPINNING WHEEL YARN GUIDE

BACKGROUND OF THE INVENTION

The present invention relates to spinning wheels and, more specifically, to apparatus associated with a spinning wheel to guide the yarn as it is wound on the bobbin.

The recent interest in manual arts and crafts has stimulated new demand for spinning wheels essentially of the same type as those commonly employed in homes in the long distant past in producing yarn from carded wool or flax. The function of the spinning wheel is to twist the animal or plant fibers, initially in an amorphous mass or ball, into a continuous yarn filament which may then be knitted or woven into cloth fabrics or other forms. As the yarn is formed it is passed over a flyer and wound upon a bobbin. The flyer and bobbin are driven at different rotational speeds about the same axis, thereby imparting the twist which produces the continuous yarn filament.

As the yarn passes from the flyer to the bobbin in most conventional wheels it is trained through an eye and over a fixed hook on one of the two flyer arms adjacent the bobbin. This results in the yarn being wound mostly at one axial position on the bobbin. In some wheels a plurality of hooks are fixedly positioned at spaced points along the flyer arm to guide the yarn to the bobbin at several points along its axial length. This requires stopping the wheel, removing the yarn from one hook and placing it on another. In any event, since the hooks are positioned at discrete points along the flyer arm, there is never a continuous distribution of the coiled yarn upon the bobbin. Although many automatic means are available for controlling the level winding of a continuous filament upon a spool or bobbin, it is desirable to maintain the simplicity and completely manual attributes of the spinning wheel.

It is the principal object of the present invention to provide a spinning wheel wherein the yarn may be guided to the bobbin at any point continuously along its axial length by entirely manually operable means.

Other objects will in part be obvious and will in part appear hereinafter.

SUMMARY OF THE INVENTION

The spinning wheel of the present invention includes the usual foot driven wheel connected by belt drive means to a pair of pulleys of different diameter. One of the pulleys is affixed to a shaft which fixedly carries the flyer. The other pulley is associated with a bobbin which is mounted upon the same shaft for free rotation with respect thereto, whereby rotation of the main wheel produces rotation of both the bobbin and flyer at different speeds. A mass of the wool or flax to be spun is held in the operator's hand and fed in a continuous line into the end of a hollow tube coaxial with the rotational axis of the bobbin and flyer, through a lateral opening or orifice in the tube, through an eye fixedly mounted upon the flyer, over a hook and to the bobbin.

Rather than being fixedly positioned on the flyer arm, the hook is attached to a metal clip or collar which encircles one of the arms for sliding movement along the length thereof. A permanent magnet is mounted on the collar and an elongated strip of magnetically permeable material is recessed in the arm to provide an exposed surface flush with the surface of the flyer arm in which it is mounted. The magnetic attraction is sufficient to maintain the position of the collar upon the flyer arm as the yarn passes over the hook to the bobbin. The collar may easily be slid along the arm, however, to reposition the hook at any desired point adjacent to and along the length of the bobbin. This may be accomplished even when the flyer is rotating, if the speed if not too great. The coil of yarn is thereby distributed substantially evenly along the length of the bobbin.

DETAILED DESCRIPTION

Figure 1:
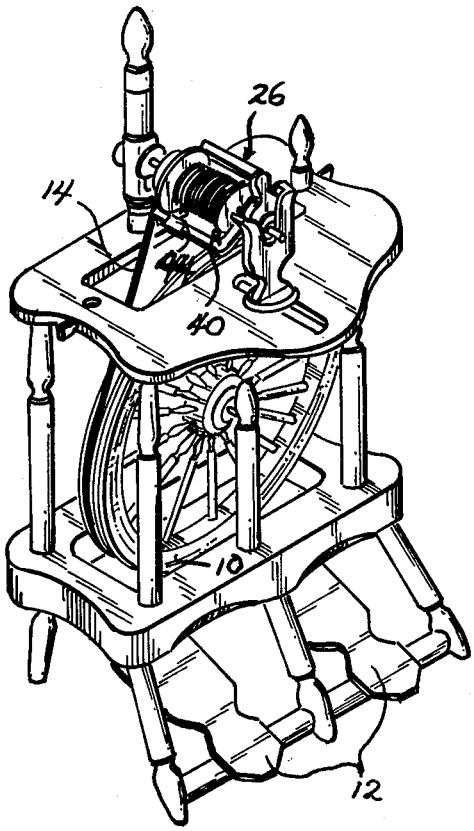
FIG. 1 is a perspective view of a spinning wheel incorporating the yarn guide apparatus of the invention.

Referring now to the drawings, in FIG. 1 is seen a spinning wheel including large wheel 10 connected by conventional linkage means to foot treadles 12 for rotational movement of the wheel by reciprocating movement of the treadles by an operator. Wheel 10 is provided with two peripheral grooves in which an endless belt 14 rides. Belt 14 is looped in FIG. 8 fashion to pass over pulleys 16 and 18 in frictional driving engagement with wheel 10 and both pulleys.

Pulley 16 is fixedly mounted on shaft 20 which is rotatably supported at one end by bearing means 22 and fixedly attached at the other end to hollow tube 24, passing through flyer 26, a U-shaped member having arms 28 and 30. Flyer 26 is affixed to shaft 20 for rotation thereby. Tube 24 is supported for rotation upon bearing means 32.

Pulley 18, of smaller diameter than pulley 16, is fixedly mounted on one end of hollow bobbin 34, having end member 36 mounted at the opposite end. Bobbin 34 fits loosely over shaft 20 for free rotation with respect thereto. Thus, rotation of pulleys 16 and 18 serves to rotate both flyer 26 and bobbin 34, the latter rotating at a faster speed due to the difference in pulley diameters.

Figure 3:
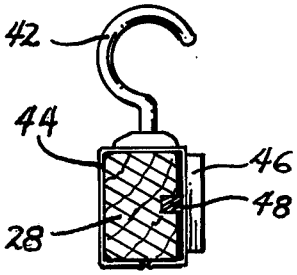
FIG. 3 is an elevational view in section on the line 3—3 of FIG. 2.

An operator of the wheel holds a loose mass of wool or flax, and threads the wheel by pulling a continuous strand of fibers from the mass and passing it into the open end of tube 24 and out of orifice 38 in the side of the tube. The strand is then passed through eye 40, fixedly positioned on flyer 26, and over hook 42 to bobbin 34. Hook 42 is affixed to steel collar 44 which encircles arm 28 of flyer 26 for sliding movement along the length thereof. Permanent magnet 46 is fixedly attached to collar 44 and elongated strip 48 of any suitable magnetically permeable material is recessed into a surface of flyer arm 28, at best seen in FIG. 3.

Figure 2:
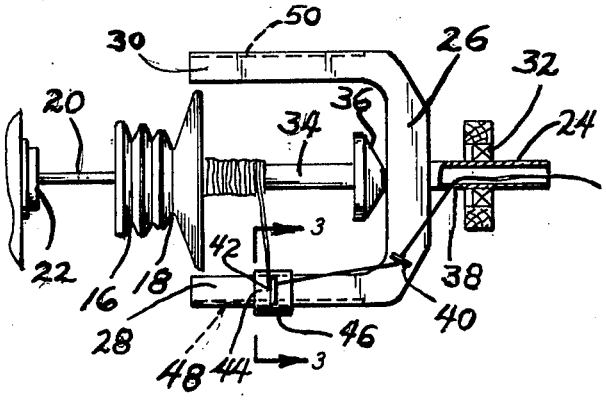
FIG. 2 is a fragmentary, elevation view, partly in section, of portions of the wheel of FIG. 1.

The attractive force exerted by magnet 46 on strip 48 yieldably retains collar 44 in the position in which it is placed by the operator of the wheel. The collar may quickly and easily be repositioned at any point along arm 28 simply by a touch from the operator, thereby distributing the yarn evenly along bobbin 34. If desired, elongated strips of magnetically permeable material may be incorporated in both flyer arms, as indicated by reference numeral 50 in FIG. 2, thus allowing collar 44 to be used in the same manner upon either of the arms. It is also contemplated that the elongated strips may be permanently magnetized and the material of collar 44 be acted upon thereby to yieldably fix the collar position.

What is claimed is:

1. In a spinning wheel for making yarn from wool or flax, apparatus for guiding the spun yarn as it is wound in a coil, said apparatus comprising:

(a) a bobbin mounted for rotation about an axis;

(b) a flyer, mounted for rotation about said axis and having a pair of arms extending substantially parallel to said axis for substantially the entire axial length of said bobbin and spaced radially outward thereof;

(c) means for imparting rotation to said bobbin and said flyer;

(d) a collar at least partially encircling one of said flyer arms for sliding movement along the length of said one arm;

(e) a yarn guide fixedly attached to said collar; and (f) a permanent magnet fixedly mounted upon one and a magnetically permeable material upon the other of said collar and said one arm, said magnet and material being relatively arranged for mutual attraction sufficient to yieldably fix the position of said collar along the length of said one arm.

2. The invention according to claim 1 wherein said permanent magnet is affixed to said collar and said magnetically permeable material is affixed to said one arm.

3. The invention according to claim 2 wherein said magnetically permeable material is in the form of an elongated metal strip.

4. The invention according to claim 3 wherein said metal strip is recessed into said one arm to present an exposed surface flush with the surface of said one arm into which it is recessed.

5. The invention according to claim 4 wherein an elongated metal strip is affixed to both of said flyer arms.

* * * * *